US005540644A

United States Patent [19]

Naraoka et al.

[11] Patent Number: 5,540,644

[45] Date of Patent: Jul. 30, 1996

[54] PACKING BAG FOR LIGHT SENSITIVE MATERIALS AND MANUFACTURING METHOD THERFORE

[75] Inventors: Naohita Naraoka, Hatano; Junichi Tamura, Yokohama, both of Japan

[73] Assignee: Konica Corporation, Tokyo, Japan

[21] Appl. No.: 957,025

[22] Filed: Oct. 6, 1992

[30] Foreign Application Priority Data

Oct. 9, 1991 [JP] Japan ..... 3-262242

[51] Int. Cl.[6] ..... B31B 1/64

[52] U.S. Cl. ..... 493/196; 493/190; 493/193; 493/194; 493/195; 493/206; 156/203; 156/308.4

[58] Field of Search ..... 493/190, 193, 493/194, 195, 196, 206; 156/203, 308.4

[56] References Cited

U.S. PATENT DOCUMENTS

| | | | |
|---|---|---|---|
| 4,394,204 | 7/1983 | Hutcheson | 156/275.1 |
| 4,642,084 | 2/1987 | Gietman, Jr. | 493/190 |
| 4,701,359 | 10/1987 | Akao | 428/35 |
| 4,702,731 | 10/1987 | Lambrecht et al. | 493/196 |
| 4,780,357 | 10/1988 | Akao | 428/216 |
| 5,075,163 | 12/1991 | Akao | 428/323 |

FOREIGN PATENT DOCUMENTS

| | | |
|---|---|---|
| 0173277 | 3/1986 | European Pat. Off. . |
| 0326181 | 8/1989 | European Pat. Off. . |
| 3-160435 | 7/1991 | Japan . |
| 4-142920 | 5/1992 | Japan . |

OTHER PUBLICATIONS

Patent Abstracts of Japan, vol. 12, No. 319 (P–751) Aug. 30, 1988, JP–A–63 085 539, Fuji Photo Film Co., Apr. 16, 1988.

*Primary Examiner*—James J. Seidleck
*Assistant Examiner*—Michael A. Williamson
*Attorney, Agent, or Firm*—Finnegan, Henderson, Farabow, Garrett & Dunner, L.L.P.

[57] ABSTRACT

A bag for packing a light-sensitive material is disclosed. The bag has an outermost surface and an innermost surface and is essentially consisting of a material for making the bag which comprises not less than 70% by weight of polyethylene and 1 to 10% by weight of a light shielding material based on the weight of the material, in which a Vicat softening point of the outermost surface is higher by not less than 20° C. than a Vicat softening point of the inner most surface. Further a method for producing a bag is disclosed. The method comprises the steps of, running a sheet for producing a bag; facing edges of the sheet which are parallel to a running direction of sheet to make an outer surface and an inner surface of the bag; heating a portion of the outer surface which is to be sealed in a heating means having a pair of heater bars with keeping a first distance between faced inner surfaces uniform and a second distance between the outer surface and one of the heater bars faced the outer surface wider than the first distance in the heating means, in which the heater bars are parallel to the running direction, the sheet is running between the heater bars continuously; and compressing the portion to be sealed.

10 Claims, 15 Drawing Sheets

PACKING BAG FOR LIGHT SENSITIVE MATERIALS AND MANUFACTURING METHOD THERFORE

FIELD OF THE INVENTION

The present invention relates to a packing bag for light-sensitive materials and a manufacturing method therefor, and more particularly to a packing bag for light-sensitive materials capable of being recycled and incinerated easily and a manufacturing method therefor.

BACKGROUND OF THE INVENTION

With regard to a barrier bag having moisture-proof and light-shielding function, among packing materials for a light-sensitive material, there have been developed various techniques for ensuring physical strength, moisture-proof and light-shielding. For ensuring the strength, for example, materials described in Japanese Patent Open to Public Inspection Nos. 237640/1986, 181944/1987 and 283944/1988 (hereinafter referred to as Japanese Patent O.P.I. Publication) and Japanese Utility Model O.P.I. Publication No. 25538/1987 may be cited, and there have been known packing materials composed of substances described in Japanese Patent O.P.I. Publication Nos. 18547/1987, 289548/1988, 290741/1988, 270535/1989, 946341/1989 and 64537/1990 as a material wherein linear low density polyethylene (LLDPE) excellent in physical properties as a film is used.

For ensuring light-shielding property, there are used light-shielding substances such as those described in Japanese Patent O.P.I. Publication Nos. 85539/1988, 82935/1989, 209134/1989, 94341/1989, 165140/1990 and 221956/1990. For ensuring moisture-proof property, there are known packing materials wherein an aluminum foil or a evaporated foil is used such as those described in Japanese Patent O.P.I. Publication Nos. 77532/1989, 251031/1989, 186338/1990 and 278256/1990.

Conventional packing materials and manufacturing methods therefor will be explained concretely as follows.

As a simple method, there may be given a means in which a bottom of a carbon-black-containing black polyethylene tube made through an inflation method and having the thickness of 60–150 μm is heat-sealed and cut to prepare a black polyethylene bag wherein light-sensitive materials are packed manually.

Bags having light-shielding property and strength described in Japanese Patent O.P.I. Publication Nos. 146539/1990 and 196238/1990 are also included in the embodiment mentioned above.

The inflation method, in this case, is a method in which a film tube extruded from a circular die attached on an extrusion machine is inflated with air gradually until it reaches its predetermined width, and then it is taken up after being flattened by nip rolls.

Incidentally, in the case of a tube made through an inflation method, it is necessary to make a tube having its own width. On the other hand, products of light-sensitive materials come in many kinds and sizes and a clearance between a packing bag and a product in the packing bag needs to be kept appropriate. Therefore, the number of sizes of packing bags has to be increased.

In general, therefore, it can not be avoided that the number of sides of bags is as many as 50 or more.

It is problematic from viewpoints of management and operation to prepare tubes in various sizes to cover all sizes of bags, and it adversely affected the producibility.

Further, what does matter most for the conventional bag is that the automatic packing is difficult.

As another embodiment, there is also used a bag made of a shut of a multi-layer structure wherein a heat-resistive material such as paper is laminated with a film having a light-shielding property and high mechanical strength as shown in FIG. 1*a*. As a light-shielding film having strength, in this case, there is generally used a sheet made of a carbon-black-containing black polyethylene tube made through the above-mentioned inflation method, the tube being cut at its both side edges before being taken up.

There is also known one wherein a laminate layer made of various materials is sandwiched between a heat resisting material and a light-shielding film. FIGS. 1*a*, 1*b*, 1*c* and 1*d* represent sectional views of various multi-layer structures for the sheet.

The heat resisting material or a heat resisting layer in this case is represented by paper as a typical one, and non-bleached, semi-bleached and bleached kraft papers are given as typical ones and their general weight is 45–190 g/m$^2$ in which a range of 50–90 g/m$^2$ is preferably used from the viewpoints of easy manufacturing of bags and strength thereof.

Further, heat-resisting material heat-resisting films such as polyethylene terephthalate, nylon or polypropylene may be used in addition to paper.

Laminated layers are formed by means of methods such as extrusion lamination, dry lamination, wet lamination and hot-melt lamination. When a web to be laminated is a resin film, methods of extrusion lamination and dry lamination are commonly used.

What does matter most for a packing material having heat resisting layers is that recycling is difficult after disposal because layers constituting a sheet, such as, for example, a heat resisting layer, a laminated layer, a moisture-proof layer, a film layer and a light-shielding strength layer are different in terms of materials and separation thereof is not easy.

When a metal such as aluminum or the like is used for a moisture-proof layer, there also is a problem that metallic residuary substances remain after incineration.

Further, examples in FIGS. 1*a* and 1*b* do not have any problem of physical strength, but examples in FIGS. 1*c* and 1*d* have problems of physical strength depending on a type of a heat resisting layer.

The inventors have found out that, in a conventional method for making a bag, when no heat resisting layer is provided, it is impossible to make a bag because an outer layer melts before an inner surface is sealed, or it is difficult to make a bag even it is possible to make because creases are caused and pinholes are frequently generated.

SUMMARY OF THE INVENTION

For the problems mentioned above, an object of the invention is to provide a packing bag for light-sensitive materials that is capable of being subjected to automatic packing and is composed of less number of kinds of packing materials to be used, excellent in recycling and incineration and is highly productive, and to provide a manufacturing method therefor.

The aforementioned object of the invention can be attained by a bag for packing a light-sensitive material, which has an outermost surface and an innermost surface, essentially consisting of a material for making the bag which comprises not less than 70% by weight of polyethylene and 1% to 10% by weight of a light shielding material based on the weight of the material, in which a Vicat softening point of the outermost surface is higher by not less than 20° C. than a Vicar softening point of the innermost surface, and a method for producing a bag comprising the steps of, running a sheet for producing a bag; facing edges of the sheet which are parallel to a running direction of sheet to make an outer surface and an inner surface of the bag; heating a portion of the outer surface which is to be sealed in a heating means having a pair of heating bars with keeping a first distance between faced inner surfaces uniform and a second distance between the outer surface wider than the first distance in the heating means, in which the heater bars are parallel to the running direction, the sheet is running between the heater bars continuously; and compressing the portion to be sealed.

Incidentally, it is preferable that at least one side of the aforementioned packing gab excluding its port is formed through heat-sealing in the method for making a bag mentioned above, and it is preferable to chill the outer surface of the sheet of the packing material during the period from heating to compressing, and to make the running speed of the end portion of the material in the heating means identical to that of the portion of the material other than the end portion, without causing any difference between them.

DETAILED DESCRIPTION OF THE INVENTION

Figure 1A:
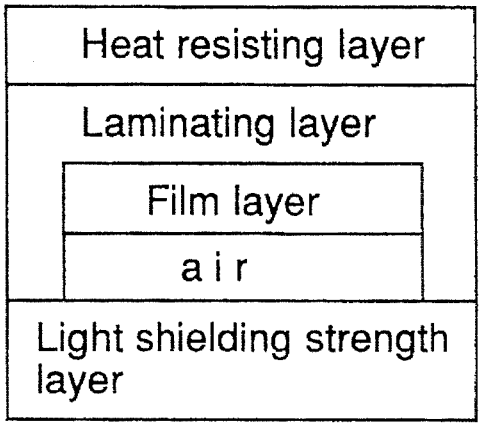
FIGS. 1*a* to 1*d* represent sectional views of packing materials.
Figure 1B:
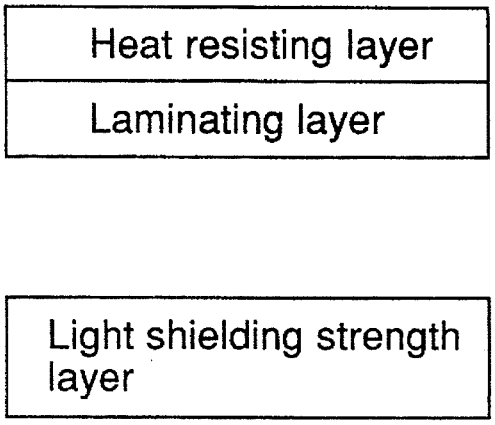
Figure 10A:
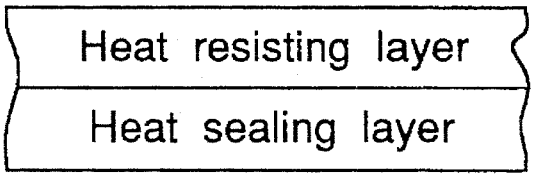
FIGS. 10*a* and 10*b* are sectional views of typical packing materials sheets of the invention.
Figure 10B:
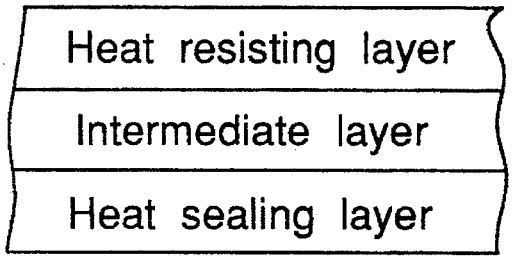

In the basic constitution of a sheet that forms a packing bag of the invention, a polyethylene layer having the high Vicat softening point, hereinafter referred to as a heat resisting PE layer for convenience' sake, and a polyethylene layer having the low Vicat softening point, hereinafter referred to as a heat-seal PE layer for convenience' sake are provided as shown in FIG. 10*a*. When making a bag, a layer having the high Vicar softening point is positioned on the outer surface of the bag. The Vicat softening point is related to the test method stipulated in JIS K 7206-1982. In the invention, the Vicar softening point in measurement under the conditions of a load on weight rod of 1 kg and a temperature change of 50° C./h is used. There may be provided an intermediate layer between two polyethylene layers as shown in FIG. 10*b*. In addition, any constitution among those shown in the aforementioned FIGS. 1*a* through 1*d* may be employed as far as the conditions for the material of the invention are satisfied. In this case, any constitution can be used for the intermediate layer,.but it is essential that the polyethylene content in the entire sheet is kept at 70 wt % or more. The polyethylene layer mentioned above may also be mixed with nylon or polypropylene for the purpose of improving the moisture proofing property. In this case again, the polyethylene content in the entire sheet needs to be 70 wt % or more, preferably 85 wt % or more. When an air layer is inserted as shown in FIGS. 1*a* and 1*b*, the polyethylene content for the weight of all layers constituting a packing material excluding the air layer needs to be 70 wt % or more. A sheet having the most preferable constitution contains only polyethylene and light-shielding substances. When making a bag, it is required that a difference of Vicat softening point between the outer surface and the inner surface is 20° C. or more, and the difference of 25° C. or more, or of 25° C.–50° C. is more preferable.

Figure 11:
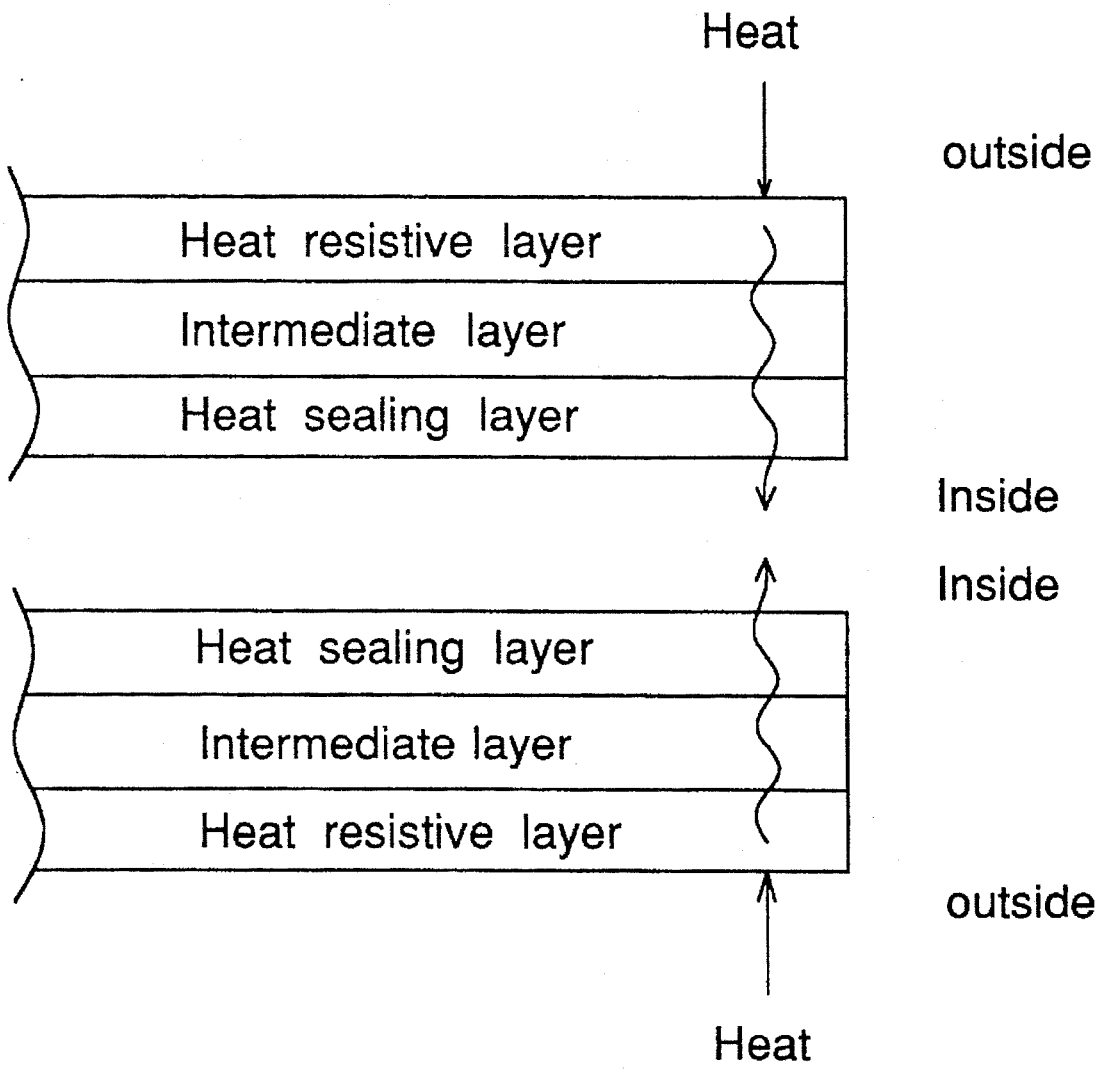
FIG. 11 is an illustration for a heat sealing method.

With the constitution mentioned above, it is possible to prevent, when heating from the outer side in the case of making a bag as shown in FIG. 11*c*, that the external surface of a sheet melts before heat arrives at a heat-seal layer.

Figure 1C:
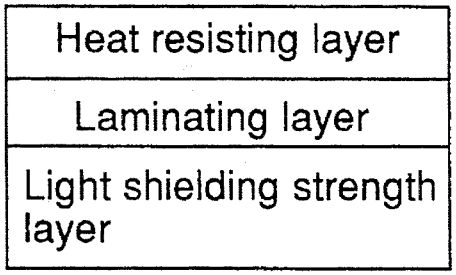
Figure 1D:
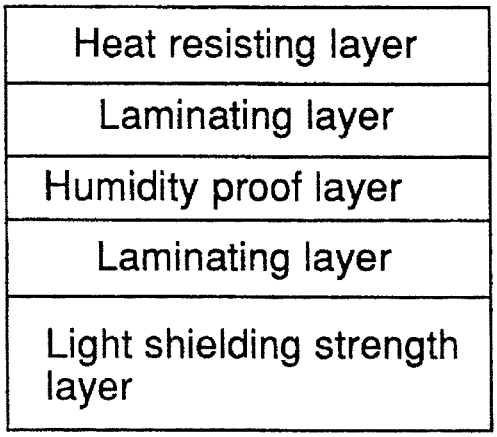

When materials stipulated in the invention are used, a property in the aspect of strength including tear strength achieved in the constitution of FIG. 1*c* or 1*d* is never inferior to those in FIGS. 1*a* and 1*b* which have been considered sufficient.

At least one of layers constituting the sheet mentioned above contains light-shielding substances. Any layer may contain light-shielding substance, and a plurality of layers may also contain simultaneously. It is necessary that the light-shielding substance content in the entire sheet is 1– 10 wt %. As a light-shielding substance, there may be given iron oxide, titanium oxide, aluminum powder, aluminum paste, calcium carbonate, barium sulfate and organic or inorganic pigment, all of which can be mixed and dispersed in polyethylene type polymer, and carbon black is preferably used.

As materials used for the layer having the high Vicat softening point and the layer having the low Vicat softening point mentioned above, there may be given high density polyethylene
(density 0.950–0.970) 117°–130° C.
medium density polyethylene
(density 0.930–0.949) 100°–120° C.
low density polyethylene
(density 0.915–0.929) 98°–110° C.
straight chained low density polyethylene
(density 0.915–0.929) 90°–105° C.
ultra-low density polyethylene
(density 0.900–0.914) 80°–95° C.

and they may be blended taking other factors such as strength and stiffness into account so that desired Vicat softening point may be obtained. From the heat resisting viewpoint, the constitution wherein the obverse is with high density polyethylene and the reverse is with low-density, straight-chained low or ultra-low density polyethylene is preferable.

As the intermediate layer mentioned above, a strength layer separated from a heat-seal layer, a moisture proofing layer and a laminated layer are cited. As materials for the strength layer, those wherein polypropylene, ethylene-propylene co-polymer or ethylene vinyl alcohol are blended with polyethylene of various kinds at need are given. For the moisture proofing layer, polypropylene, nylon, and vinylidene chloride are given, and polypropylene is preferable from the recycling viewpoint. For the laminated layer, various kinds of polyethylene, ionomer resin and various kinds of adhesives are given. In any case, only polyethylene is preferable from the recycling viewpoint, and next preferable one is polyolefin type polypropylene. An amount of those other than the aforementioned is required to be small as far as possible. Otherwise, highly pure recycling polymer can not be obtained.

A laminate layer is provided for adhesion of the upper and lower layers. With regard to the intermediate layer, a value of the Vicar softening point is not limited in particular. The thickness of a heat resisting layer and a heat-seal layer is preferably at least 20 μm or more, and more preferably 30–70 μm. The total thickness of a sheet is preferably 120–200 μm, and more preferably 130–170 μm.

When packing operation is considered here, it is not preferable that the outer side of a packing material has an absorption color because light-sensitive materials are usually packed in a dark room.

It is therefore preferable that a layer visible from outside contains pigment or the like of a reflection color or either one of the obverse and reverse sides of a layer visible from outside is printed with a reflection color.

The degree of reflection mentioned above is determined collectively depending on a dark room grade, cost and physical properties. However, less pigment and less printing are preferable from the recycling viewpoint. Incidentally, with regard to packing materials, the light-reflective outer surface thereof is preferable for the reason mentioned above, but the light-absorbing surface is preferable for other layers.

FIGS. 2*a* and 2*b* and FIGS. 3*a*, 3*b* and 3*c* represent perspective views showing various methods for making packing bags. In the figures, hatched portions represent sealed areas.

Figure 2A:
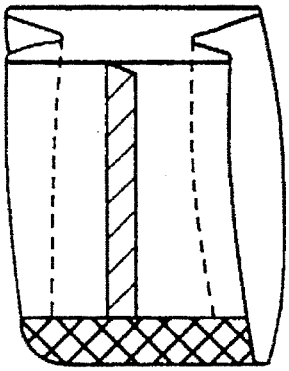
FIGS. 2*a* to 2*b* show perspective views showing shapes of packing bags and FIGS. 2*c* to 2*e* show heat sealed portion of the bags of FIGS. 2*a* and 2*b*.

FIG. 2*a* shows a packing bag having a center seal and a bottom seal as well as folded portions. A packing bag shown in FIG. 2*b* has no folding portion. FIG. 2*c* is a bottom view of a packing bag in FIG. 2*a* viewed from the bottom thereof and FIG. 2*d* is a bottom view of a packing bag in FIG. 2*b* viewed from the bottom thereof. Pinholes tend to take place at locations marked with a circle in FIGS. 2*c* and 2*d*. In the case of a bottom seal as stated above, pinholes are easily caused at locations shown in FIGS. 2*c* and 2*d*. It is, therefore, preferable that the bottoms are folded as shown in FIG. 2*e*.

Figure 3A:
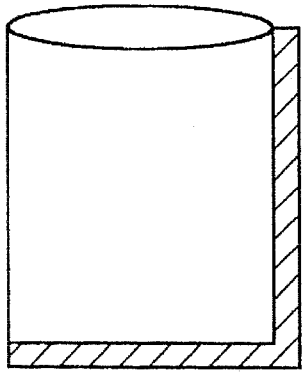
FIG. 3*a* to 3*c* represent perspective views showing shapes of packing bags of the invention.
Figure 3B:
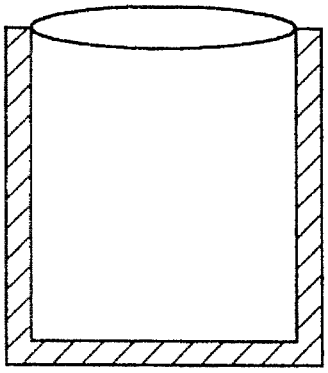
Figure 3C:
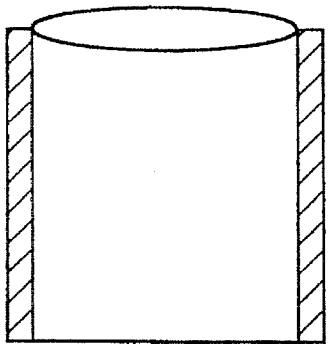

A packing bag shown in FIG. 3*a* is generally called an L-shaped seal wherein a sheet of a web is folded double to be a packing bag. A packing bag shown in FIG. 3*b* is called a three-side seal wherein two sheets of web are combined and it is commonly used for large-sized bags. A packing bag shown in FIG. 3*c* is called a two-side seal which is different from in the L-shaped seal in FIG. 3*a* in terms of the relation between a bag mouth and a sealing position.

After these bags are stuffed with products, a mouth of each bag is subjected to heat-sealing or is folded several times and sealed with a tape.

Figure 4A:
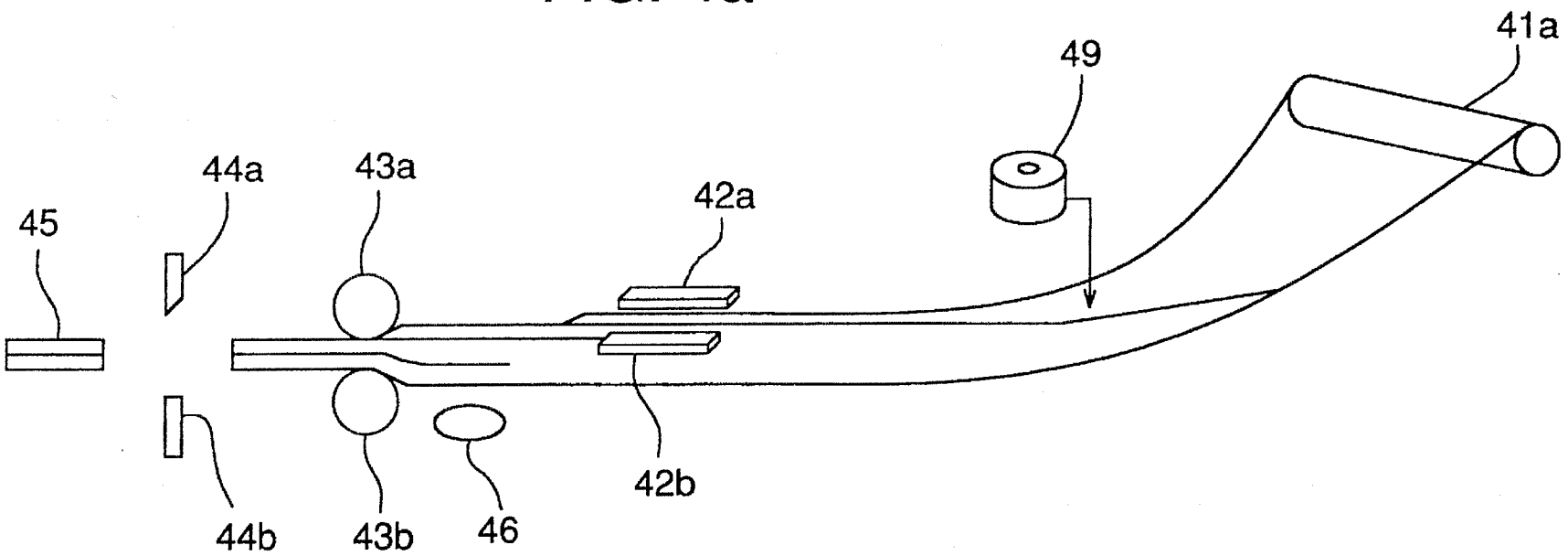
FIG. 4*a* is an illustration showing an example of a method for making a packing bag and FIGS. 4*b* and 4*c* are shape of bags made by the method of FIG. 4*a*.
Figure 4C:
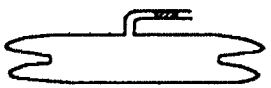
Figure 4B:
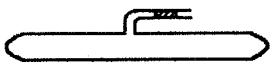
Figure 5:
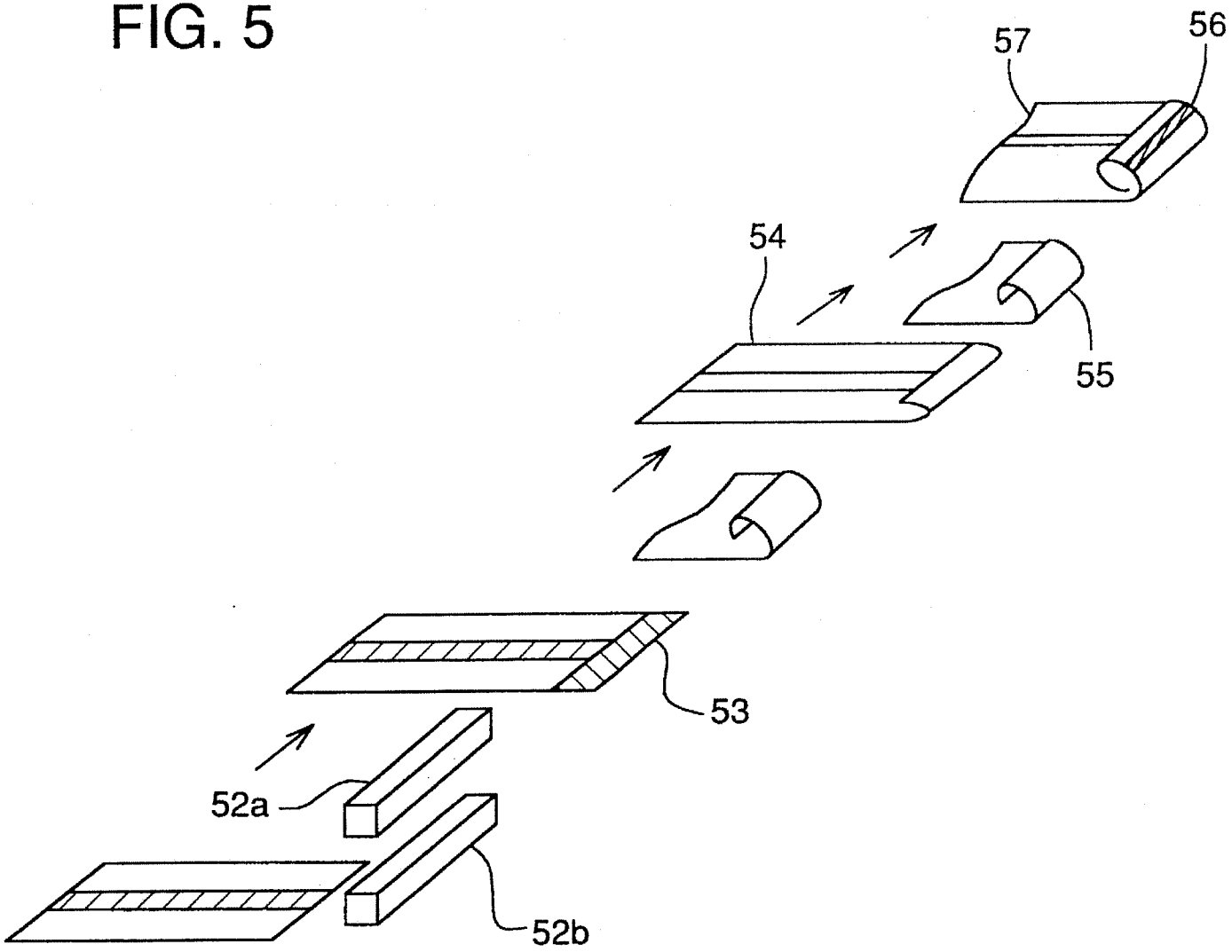
FIG. 5 is an illustration showing an example of a method for making a packing bag.

FIGS. 4 and 5 are schematic diagrams each showing an example of an automatic bag-making machine or a bag-making and packing machine usable for making a bag using a packing sheet of the invention.

Figure 2B:
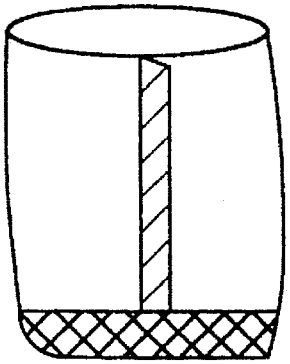
Figure 2C:
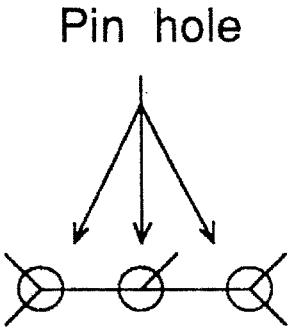
Figure 2D:
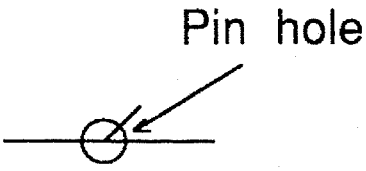
Figure 2E:
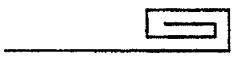

In the case of FIGS. 2*a* and 2*b*, methods in FIG. 4*a* and FIG. 5 are used for automatic packing.

Packing materials 41*a* wound in a roll shape pass through the gap between heater bars 42*a* and 42*b* to be subjected to heat-sealing after being superposed each other at their both edges. After that, they are pressed by pressure rollers 43*a* and 43*b* and then are cut by cutters 44*a* and 44*b*, thus packing bag 45 is made. In this case, when guides for forming the folded portion 46 are inserted from both sides, a gusset bag shown in FIG. 2*a* is formed, and when no guide is inserted, a flat bag shown in FIG. 2*b* is formed. Incidentally, at the position of the numeral 45, the bag is in a shape of a tube shown in FIGS. 4*b* and 4*c*.

When a tube-shaped bag made by the machine such as shown in FIG. 4*a* is sealed by 52*a* and 52*b* as shown in FIG. 5, folded by guide 53, coated with adhesives at the point of the numeral 54 and further folded by guide 55, the adhesives coated at the point of 54 are extended to be a line as shown with the numeral 56 as the tube advances, thus packing bag 57 is formed.

In this case, when a light-sensitive material to be packed 49 is supplied into the bag by means of a conveyor or a robot at the point preceding the heater bars 42*a* and 42*b* in FIG. 4, and a bottom and a mouth of the bag are processed as shown in FIG. 5, automatic packing can be carried out. In the folding method in this case, the bag is folded continuously as it advances along the guide. However, it is also possible to employ another method wherein the bag advances discontinuously so that all portions are folded at a time with upper and lower sides nipped.

Figure 6A:
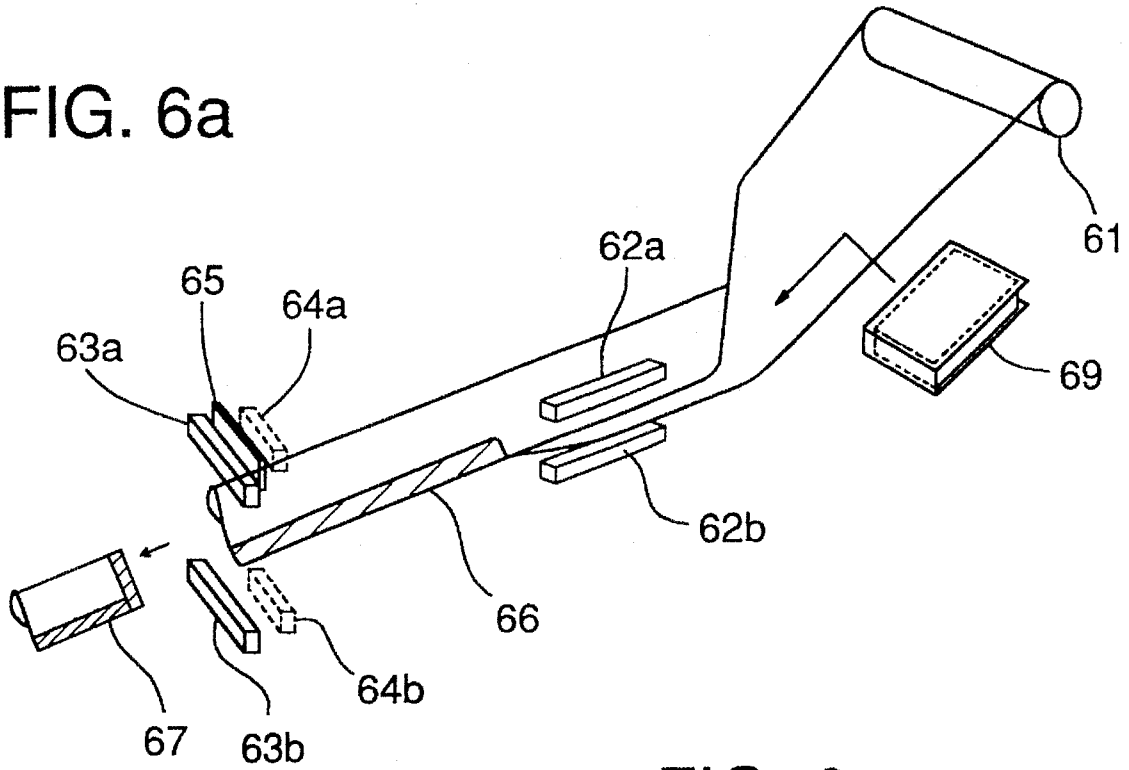
FIG. 6*a* is an illustration showing an example of a method for making a packing bag and FIGS. 6*b* and 6*c* show packages made by the method of FIG. 6*a*.

FIG. 6*a* is a schematic diagram showing an example of a bag-making method for an L-shaped seal bag shown in FIG. 3*a* or an automatic packing method. This is similar to the method in FIG. 4 except that a web of sheet folded double is sealed at its edge portion .while the web folded double in FIG. 4 is sealed at its center. When web of sheet 61 is folded double and sealed by heater bars 62*a* and 62*b* and then pressed by intermittent heater bars 63*a* and 63*b* and cut simultaneously by cutter 65, an L-shaped seal bag can be formed. The numeral 66 means a sealed portion.

Figure 6C:
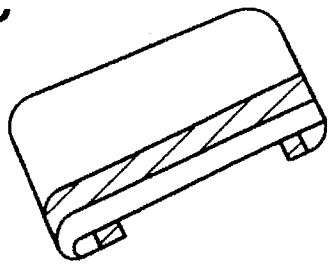
Figure 6B:
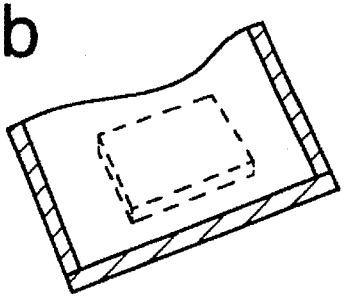

Even in this case, it is possible to carry out automatic packing of products as shown in FIG. 6*b* if a light-sensitive material to be packed 69 is packed in and heater bars 64*a* and 64*b* for sealing a mouth of a bag are provided as in the case of FIG. 4.

In some cases in the foregoing, a sealed portion is further folded as shown in FIG. 6*c* if necessary. The reason for this is to assure the light-shielding capability of the sealed portion and to reduce the volume of a box in which packing bags stuffed with products are put in.

Figures 7A, 7B:
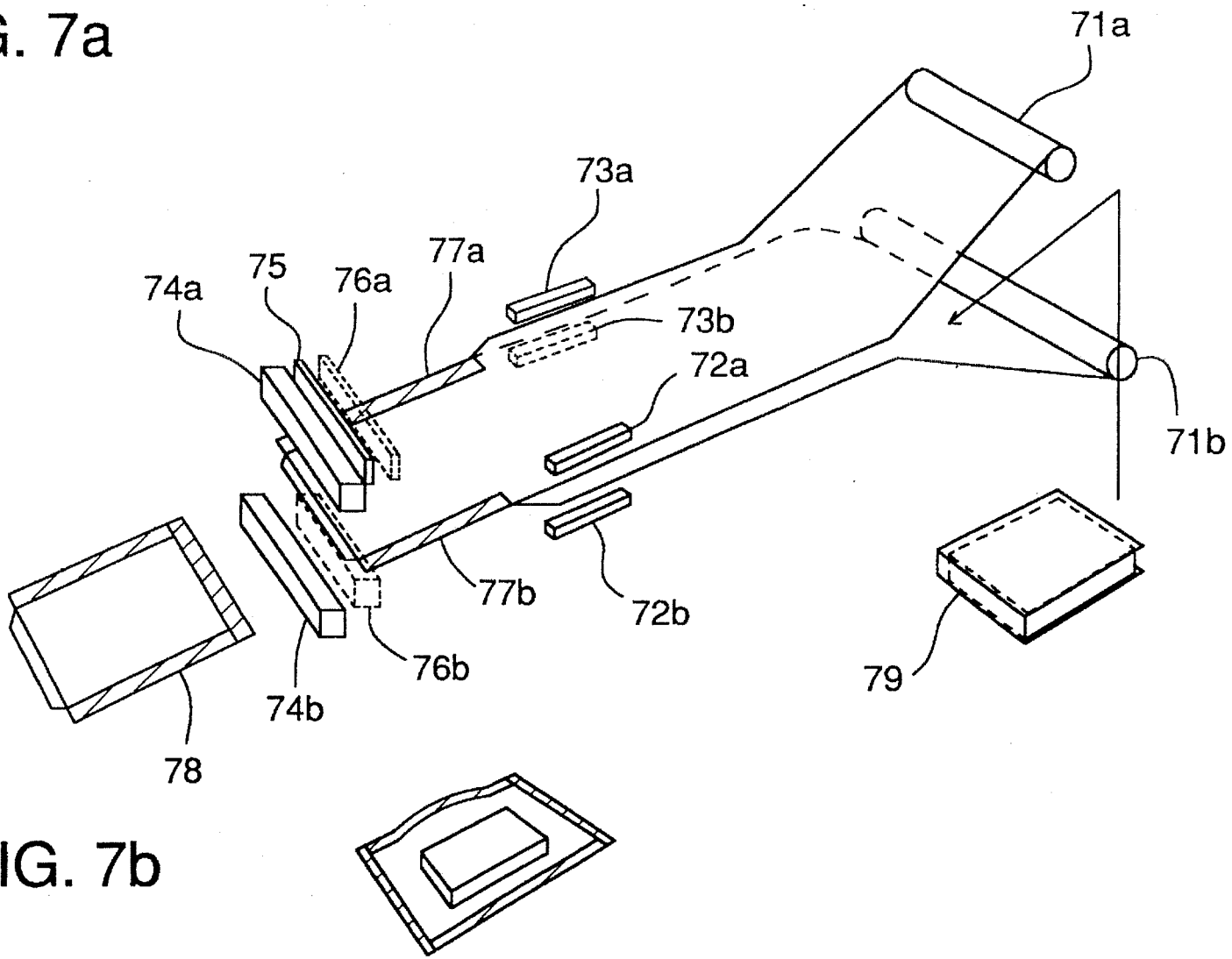
FIG. 7*a* is an illustration showing an example of a method for making a packing bag and FIG. 7*b* shows a package made by the method of FIG. 7*a*.

Next, three-side sealing in FIG. 3*b* will be explained. FIG. 7 is a schematic diagram showing an example of a method for making a three-side sealing bag or of a method for an automatic packing.

When webs of sheet 71*a* and 71*b* each being wound in a roll shape are superposed with their light-shielding layers facing each other, both edges thereof are sealed by heater bars 72*a*, 72*b*, 73*a* and 73*b*, other side is further sealed by heater bars 74*a* and 74*b*, and sealed sheets are cut by cutter 75, three-side-sealed bag 78 can be formed. It is further possible to carry out automatic packing and obtain packed products shown in FIG. 7*b* when a light-sensitive material to be packed 79 is packed in the same way as in FIGS. 4 and 5 and heater bars 76*a* and 76*b* are provided. The symbols 77*a* and 77*b* represent a shielded portion.

Even in this case, a sealed portion may sometimes be folded in a shape similar to that shown in FIG. 6*c*.

Figure 8:
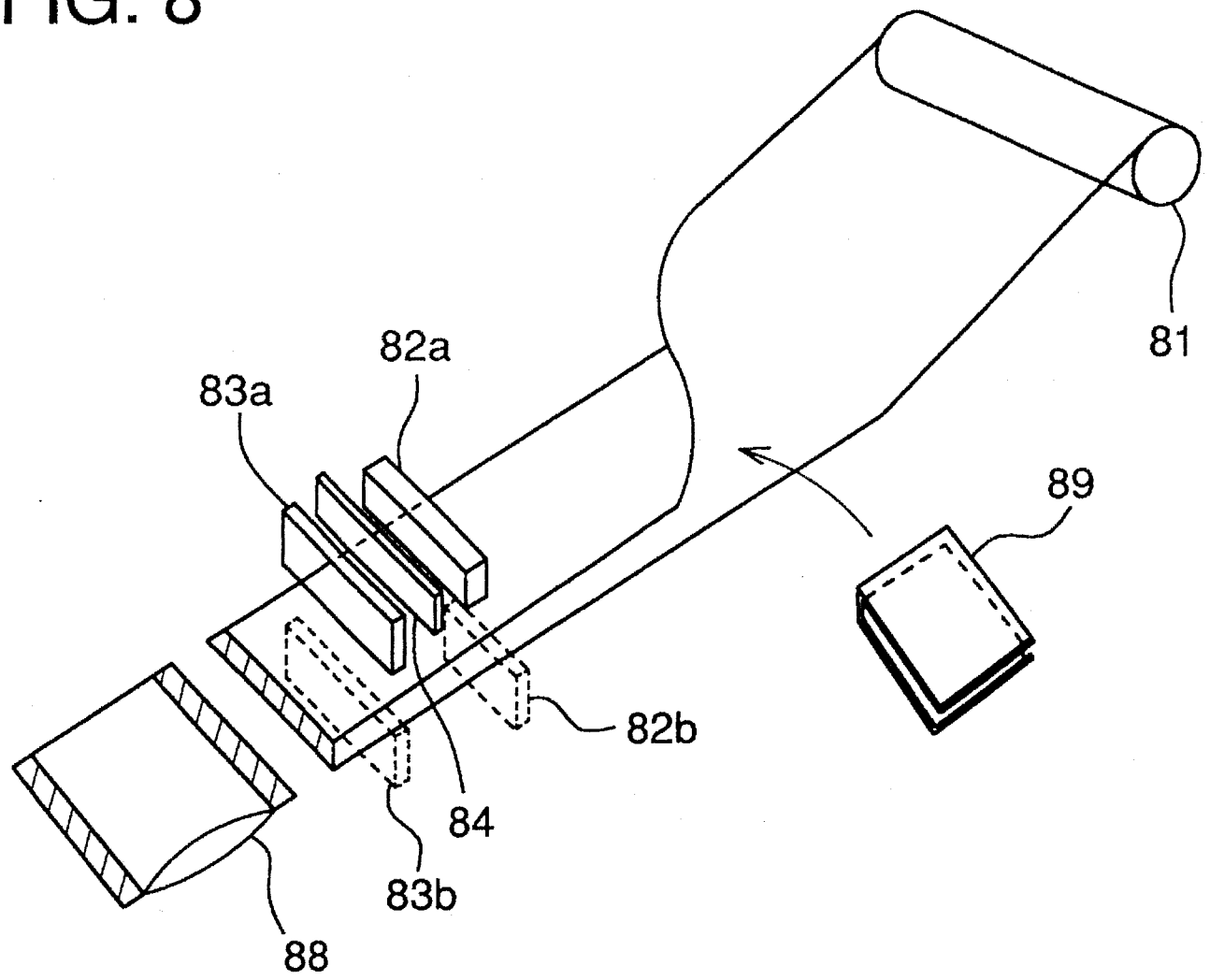
FIGS. 8 and 9 are each an illustration showing an example of a method for making a packing bag.
Figure 9:
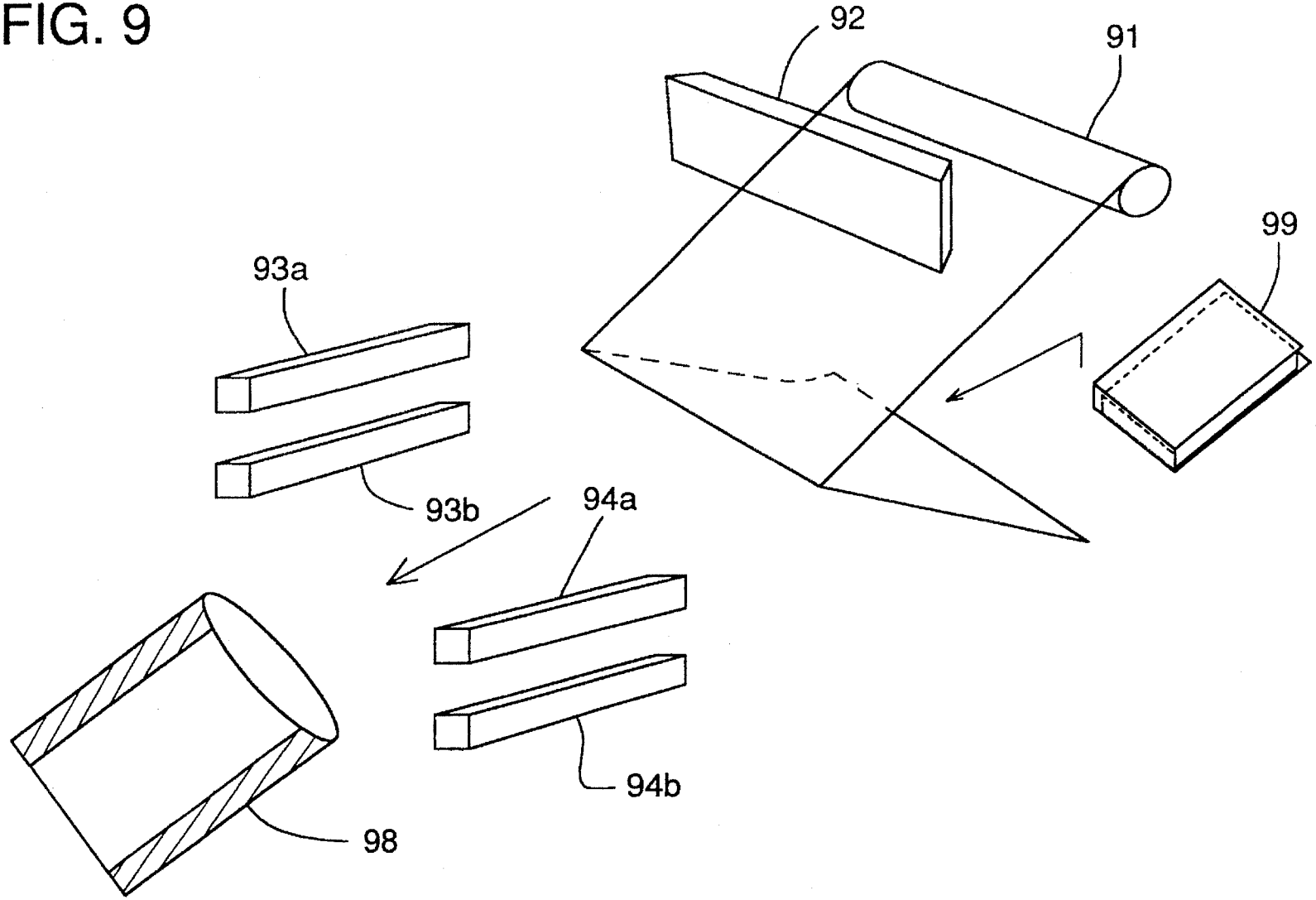

An example shown in FIG. 3*c* will be explained next. FIGS. 8 and 9 represent schematic diagrams showing an example of a method for making a two-side-sealed bag or of an automatic packing method. In the case of FIG. 8, a sheet of web is folded double and two sides thereof are sealed simultaneously by two sets of heater bars 82*a*, 82*b*, 83*a* and 83*b*, and cutter 84 is used for cutting for obtaining bag 88. Even in this case, it is possible to carry out automatic packing by packing in a light-sensitive material 89. FIG. 9 also shows an occasion of two-side sealing wherein a web of sheet 91 is folded longitudinally and sealed by heater bars 93*a*, 93b, 94*a* and 94*b*, while in FIG. 8*a* web of sheet 81 is folded laterally. In FIG. 9, 92 is a cutter and 99 is a light-sensitive material to be packed.

Figure 12A:
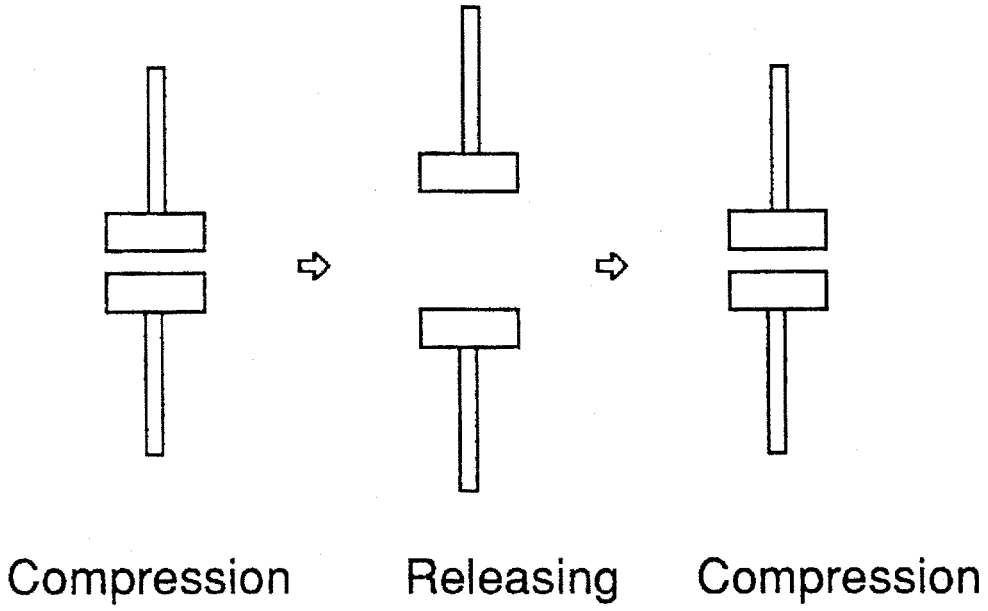
FIGS. 12*a* and 12*b* are each an illustration for a heat sealing method.
Figure 12B:
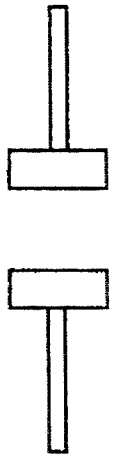

For sealing by means of heater bars, when the sealing direction is perpendicular to the running direction of a web of sheet, for example, in the case of 82*a*, 82*b*, 83*a* and 83*b* in FIG. 8, sealing is only carried out intermittently by heaters moving vertically as shown in FIG. 12*a*. However, when the sealing direction is in parallel with the running direction of a web of sheet, for example, in the case of 93*a*, 93*b*, 94*a* and 94*b* in FIG. 9, it is possible to carry out the sealing wherein the web continuously passes through a gap kept between heater bars for sealing as shown in FIG. 12*b*.

In the latter case, no crease is caused on a sealed surface, no time is necessary for heater bars to move and productivity is high because of continuous movement of a web of sheet, which are advantageous points.

The present packing material of invention shows more effects for the continuous sealing method mentioned above.

When this method is employed with preparation of a certain number of types in width of master rolls of sheet, advantages on operational management may be expected for processing on apparatuses shown in FIGS. 4, 5, 6, 7, and 9 when the master roll of the sheet is slit by a slitter to the necessary width in advance because the number of sizes in this method is smaller than that in tubes made through an inflation method, since the width smaller than the master roll of sheet is prepared depending on the size of a bag to be made.

In the method for making bags wherein intermittent heat-sealing is conducted as shown in FIG. 12*a*, a heated pressure-applying means presses a film to be sealed from its back side for sealing, which requires the film to be suspended while it is being pressed. This lowers the processing speed sharply, resulting in a demerit. For the continuous sealing, it is preferable that a heating step is separated from a pressing step, and films arranged on a face-to-face basis are heated from their backs while they are traveling, and heated films are pressed continuously for sealing. One of the problems in this case is occurrence of air bubbles inside the sealed portion, and the other is occurrence of a difference of deformation caused by heat between the sealed portion and other portions.

Figure 13:
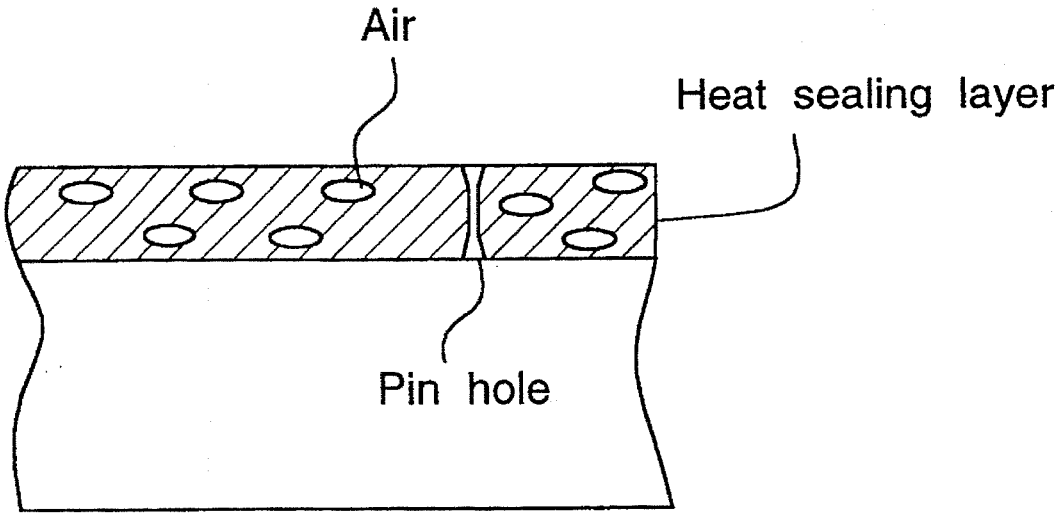
FIG. 13 is an illustration indicating how air bubbles are generated.

Air mixing in this case means an air bubble generated at random on a sealed portion as shown in FIG. 13, and when the air mixing is serious, pinholes are generated as shown in FIG. 13 causing defective light-shielding and insufficient strength.

Figure 14A:
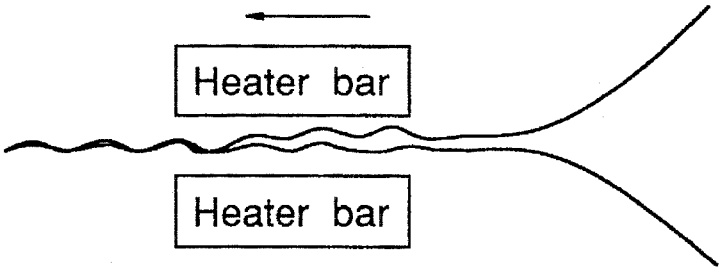
FIGS. 14*a* to 14*d* are each an illustration indicating how sheets are sealed.

The air mixing is caused when a partial heat-sealing is conducted in advance due to the uneven clearance between webs of sheet in the pre-heating zone between heater bars shown in FIG. 14*a*.

Figure 14B:
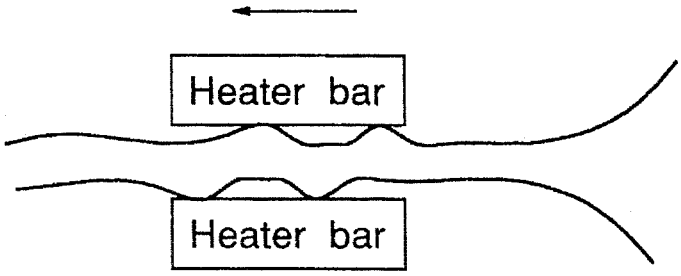

When a clearance between a web of sheet and a heater bar is smaller than that between sheets as shown in FIG. 14*b*, the same phenomenon as in FIG. 14*a* takes place even when the sheets enter the pre-heating zone with a uniform clearance there between because of the deformation caused by heat which makes the clearance between webs uneven.

For preventing the phenomenon mentioned above, it is preferable that the distance between two sheets of films in the heating zone is made uniform, and the distance between a heater bar and the back of the film to be heated is made greater than that between films facing each other in the heating zone, to be at least 0.5 mm. For keeping the distance between the films in the heating zone constant, the films may be pressed uniformly by nip rollers before the films enter the heating zone as shown in FIG. 14*c*, or a spacer may be placed between the films in the heating zone as shown in FIG. 14*d*.

Figure 14C:
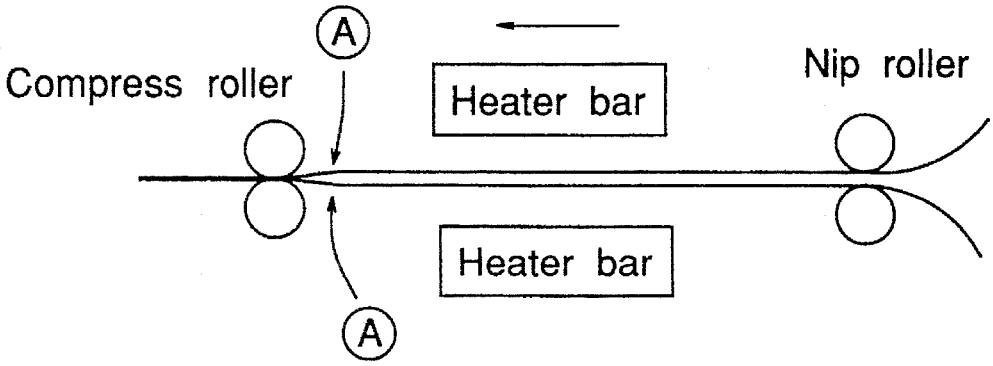
Figure 14D:
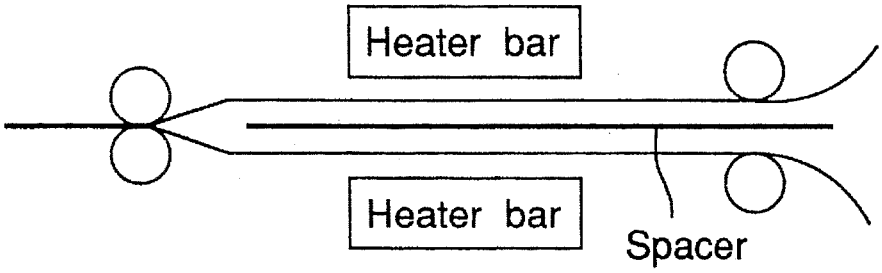
Figure 15:
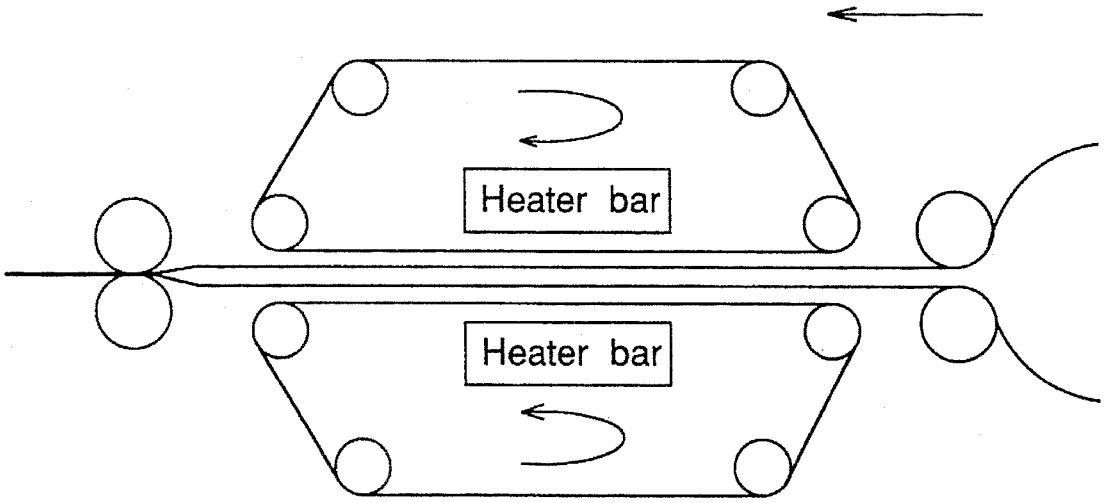
FIG. 15 is an illustration showing a heat sealing method.

For the problem mentioned above, compression rolls can be provided to compress sheets behind the heater zone as shown in FIG. 14*c*. With this arrangement, it is possible to seal at lower temperature and air mixing can be prevented.

Further, in this case, the outer side of a web is sometimes peeled, scratched or creased when the sheets are compressed by the compression rolls, because the outer side of the sheet is heated.

For preventing the problem mentioned above, a method for chilling the outer side only after heating is effective.

In FIG. 14*c*, therefore, it is preferable that sheets are chilled by air or water from the outside at the portion marked with A.

Another problem to be explained is a difference of deformation on a sealed portion caused by heat which will be explained as follows. This problem is caused by a difference of running speed between a web of sheet in the heating zone and a web which is not in the heating zone. The reason for this is that the running speed of the web in the heating zone is slowed down because the web is deformed to some degree or is pulled by a heater bar even when the aforementioned action is taken. When this phenomenon takes place, creases are generated or even pinholes are generated when the creasing is serious.

In conventional processing methods, a driving system for webs has only been located far away from heaters and consequently, the running speed of the web of sheet tends to differ partially. This is a cause for the problem mentioned above.

To cope with this problem, the auxiliary force to drive webs of sheet at the point of heaters or the point immediately after heaters is preferable.

As a means for the auxiliary force, it is preferable that compression rollers in FIG. 14*c* are linked (to be identical in speed) with a driving system of the sheet.

There further is available a method wherein rotating heat resisting belts which are linked (to be identical in speed) with a driving system and rotate around heater bars are provided, and an end portion of the web sheet is sandwiched in the rotating heat resisting belts to be advanced by friction through the heater zone.

Aforementioned method is suitable for manufacturing packing material of the invention mentioned above, and it also produces good results in manufacturing of the conventional packing materials.

EXAMPLES

Example 1

A material for bag making was prepared as follows.

| | |
|---|---|
| (Heat resisting layer) | |
| High density polyethylene (melt index MI 0.05, density 0.956 g/cm$^3$, a Vicat softening point 124°) | 30 μm thick |
| (light-shielding strength layer) | |
| Medium density polyethylene (MI 0.024, density 0.945 g/cm$^3$) | 38% by weight |
| Straight chained low density polyethylene (MI 1.0, density 0.915 g/cm$^3$) | 38% by weight |
| Low density polyethylene (MI 7.0, density 0.922 g/cm$^3$) | 10% by weight |
| Ethylene propylene type rubber (density 0.86 g/cm$^3$) | 9% by weight |
| Carbon black | 5% by weight |

A film wherein light-shielding strength heat sealing layer composed of the aforementioned materials having a thickness of 100 μm and a Vicat softening point of 102° C. was laminated by low density polyethylene (MI 5.0, density 0.924 g/cm$^3$) film 10 μm thick.

Example 2

An inner side of the heat resisting layer in Example 1 was subjected to printing in white.

Example 3

The heat resisting layer in Example 1 was caused to contain 10% by weight of titanium oxide.

Example 4

In composition of Example 1, the light-shielding layer was replaced by one having the following composition.

| | |
|---|---|
| (light-shielding strength heat sealing layer) | |
| Ultra-low density polyethylene (MI 0.8, density 0.905 g/cm$^3$) | 45% by weight |
| High density polyethylene (MI 0.03, density 0.954 g/cm$^3$) | 30% by weight |
| Ethylene vinyl alcohol | 15% by weight |
| Low density polyethylene (MI 7.0, density 0.922 g/cm$^3$) | 6% by weight |
| Carbon black | 4% by weight |
| Thickness | 100 μm |
| Vicat softening point | 98° C. |

Example 5

| | |
|---|---|
| High density polyethylene (MI 0.3, density 0.964 g/cm$^3$) | 89% by weight |
| Low density polyethylene (MI 2.0, density 0.924 g/cm$^3$) | 6% by weight |
| Carbon black | 5% by weight |

A film having the above composition was prepared, which was 33 μm in thick and had a Vicat softening point of 126° C. The film was subjected to uniaxial stretching with a magnification of 1.4. Two sheets of the stretched film were laminated by extrusion with a layer of 9 μm thick of low density polyethylene (MI:12.0, density:0.942 g/cm$^3$) so that the stretched axes of the films were crossed each other at right angles. Thus a film of 75 μm thick for heat resisting strength layer was obtained. To prepare a packing material, the above film for heat resisting strength layer and a low density polyethylene film (MI:2.0, density:0.923 g/cm$^3$, Vicat softening point:95° C.) of 40 μm thick for heat sealing layer were laminated by extrusion with a layer of 15 μm of low density polyethylene (MI:1.5, density:0.924 g/cm$^3$).

Example 6

| | |
|---|---|
| (Heat resistant light-shielding outer layer) | |
| High density polyethylene (MI 0.05, density 0.956 g/cm$^3$) | 89% by weight |
| Low density polyethylene (MI 2.0, density 0.924 g/cm$^3$) | 6% by weight |
| Carbon black | 5% by weight |
| Thickness | 55 μm |
| Vicat softening point | 124° C. |
| (Moisture-proof intermediate layer) | |
| Nylon | 100% by weight |
| Thickness | 20 μm |
| (Heat resistant light-shielding inner layer) | |
| Low density polyethylene (MI 2.0, density 0.923 g/cm$^3$) | 89% by weight |
| Low density polyethylene (MI 2.0, density 0.924 g/cm$^3$) | 6% by weight |
| Carbon black | 5% by weight |
| Thickness | 55 μm |
| Vicat softening point | 95° C. |

A film made from the aforementioned three layers subjected to multi-layer extrusion.

Example 7

| | |
|---|---|
| (Heat resisting layer) | |
| High density polyethylene (MI 0.05, density 0.956 g/cm$^3$) | 85% by weight |
| Low density polyethylene (MI 7.0, density 0.922 g/cm$^3$) | 9% by weight |
| Titanium oxide | 6% by weight |
| Thickness | 70 μm |
| Vicat softening point | 120° C. |
| (Light-shielding strength layer) | |
| Medium density polyethylene (MI 0.024, density 0.945 g/cm$^3$) | 38% by weight |
| Straight chained low density polyethylene (MI 1.0, density 0.915 g/cm$^3$) | 38% by weight |
| Low density polyethylene (MI 7.0, density 0.922 g/cm$^3$) | 10% by weight |
| Ethylenepropylene type rubber (density 0.86 g/cm$^3$) | 9% by weight |
| Carbon black | 5% by weight |
| Thickness | 100 μm thick. |
| (Heat-sealing layer) | |
| Low density polyethylene (MI 2.0, density 0.923 g/cm$^3$) | 100% by weight |
| Thickness | 20 μm |
| Vicat softening point | 95° C. |

A film prepared by causing the above three layers to be subjected to multi-layer extrusion.

Example 8

| (Heat resisting light-shielding strength layer 1) | |
|---|---|
| High density polyethylene (MI 0.3, density 0.964 g/cm$^3$) | 85% by weight |
| Low density polyethylene (MI 2.0, density 0.924 g/cm$^3$) | 9% by weight |
| Titanium oxide | 6% by weight |
| Thickness | 32.5 μm |
| Vicat softening point | 126° C. |
| (Heat resisting light-shielding strength layer 2) | |
| High density polyethylene (MI 0.04, density 0.955 g/cm$^3$) | 43% by weight |
| Straight chained low density polyethylene (MI 2.1, density 0.920 g/cm$^3$) | 43% by weight |
| Medium density polyethylene (MI 1.6, density 0.935 g/cm$^3$) | 9% by weight |
| Carbon black | 5% by weight |
| Thickness | 32.5 μm |

A heat resisting light-shielding strength layer prepared by causing the above two layers of 65 μm thick in total to be subjected to multi-layer extrusion under uniaxial orientation with orientation magnification of 1.4.

| (Light-shielding strength heat-seal layer 1) | |
|---|---|
| High density polyethylene (MI 0.04, density 0.955 g/cm$^3$) | 43% by weight |
| Straight chained low density polyethylene (MI 2.1, density 0.920 g/cm$^3$) | 43% by weight |
| Medium density polyethylene (MI 1.6, density 0.935 g/cm$^3$) | 9% by weight |
| Carbon black | 5% by weight |
| Thickness | 32.5 μm |
| (Light-shielding strength heat-seal layer 2) | |
| Low density polyethylene (MI 2.0, density 0.923 g/cm$^3$) | 100% by weight |
| Thickness | 32.5 μm |
| Vicat softening point | 95° C. |

A light-shielding strength heat-seal layer prepared by causing the above two layers of 65 μm thick in total to be subjected to multi-layer extrusion under uniaxial orientation with orientation magnification of 1.4. No change in the Vicat softening point was observed after orientation.

A film prepared by causing the above-mentioned two layers to be extrusion-laminated with low density polyethylene (MI 2.0, density 0.924 g/cm$^3$) of 9 μm thick in a way that orientation axes intersect at right angles.

Comparative Example 1

A two-layer packing bag made through a method in FIG. 4, and is composed of a non-bleached kraft paper having a weight of 83 g/m$^2$ laminated with 15 μm thick low density polyethylene (MI 2.0, density 0.924 g/cm$^3$) and 100 μm thick heat sealing layer in Example 1. In this case, only a guide is provided in a nip roller position in FIG. 14*c* and a clearance between heater bars was 1.0 mm, and compression was performed by the heater bars without compression rollers.

Comparative Example 2

A comparative example prepared by dry-laminating four layers including a bleached kraft paper having a weight of 83 g/m$^2$, a 7 μm thick aluminum foil, a 15 μm thick nylon foil and a 60 μm thick heat sealing layer in Example 1 with 3 μm thick polyester type adhesives.

Comparative Example 3

A comparative example prepared by extrusion-laminating three layers including a 25 μm thick polyethylene terephthalate film, a 7 μm thick aluminum foil and an 80 μm thick heal sealing layer in Example 1 with 15 μm thick low density polyethylene (MI 2.0, density 0.924 g/cm$^3$).

Evaluation of packing material sheet

All samples of examples and comparative Examples mentioned above (Comparative Example 1 is in the state of a bag) were subjected to tests for the tear strength, moisture proofing, flammability and aptitude for recycling.

Tear strength: Under JIS-P-8116

Moisture proofing: Under Condition B of JIS-Z-0208

Flammability: Whether metallic sludge remains after combustion or not.

Aptitude for recycling: Whether or not it can be recycled. When it is possible to recycle, evaluation was made by the revel of tear strength of film prepared by recycled bag material.

Criteria for evaluation are as follows.

Flammability: A: no metallic sludge,
B: with metallic sludge

Aptitude for recycling: A: 30% or more,
B: 30–10%,
C: less than 10%,
D: Impossible to reuse The test results are shown in Table 1.

TABLE 1

| | | Example 1 | Example 2 | Example 3 | Example 4 | Example 5 | Example 6 | Example 7 | Example 8 | Comparative example 1 | Comparative example 2 | Comparative example 3 |
|---|---|---|---|---|---|---|---|---|---|---|---|---|
| Thick-ness | | 140 μm | 140 μm | 140 μm | 140 μm | 130 μm | 130 μm | 140 μm | 140 μm | 225 μm | 170 μm | 142 μm |
| Tear strength *1 | Lateral direction | 3200 | 3200 | 3200 | 3200 | 3200 | 1500 | 3200 | 3200 | 3200 | 500 | 1000 |
| | Longitudinal direction | 1800 | 1800 | 1800 | 2000 | 2000 | 600 | 2500 | 3200 | 2800 | 300 | 700 |
| Moisture-proof *2 | | 2.1 | 2.1 | 2.1 | 2.1 | 2.0 | 1.5 | 2.1 | 2.1 | 2.7 | 0.5 | 0.5 |
| Flamability | | A | A | A | A | A | A | A | A | A | B | B |
| Aptitude for recycling | | A | A | A | B | A | C | A | A | D | D | D |

*1 JISP8116

*2 in gram of $H_2O$ penetrated through 1 m$^2$ for 24 hours at 40° C. in humidity of 90%

The results shown in Table 1 indicate that the samples of the invention are excellent in the aptitude for recycling after use and for incineration, and strength and high productivity for them can be assured.

Then, each sheet (excluding comparative examples) was prepared through the following method.

(Bag-making method)

A method shown in FIG. 4 was used, and a pressure roller and nip rollers shown in FIG. 14*c* were provided. A clearance between webs was adjusted by nip rollers to be 0.1 mm or less, and a clearance between the web and a heater bar was adjusted to be 0.8 mm (method of the invention).

In the conventional manufacturing method shown in Table 2, only a guide is provided in a nip roller portion in FIG. 14*c* where a clearance between heater bars is 1.0 mm and pressing is done by the heater bars and pressure rollers are not provided.

Incidentally, Comparative example 1 was prepared through the conventional manufacturing method, and a sheet prepared through the method of the invention employing the same materials as in the Comparative example 1 is also shown in Table 2 as Comparative example 1.

Further, as Comparative example 4, the one employing the sheet shown below is also described in Table 2.

Comparative Example 4

Single film of a 130 μm thick heat sealing layer in Example 1.

With regard to the sheet of Example 2, a chilled water zone was provided at zone A in FIG. 14 when a bag was made in the method of the invention.

With regard to each sheet of Examples 3, 7 and 8, a chilled water zone was provided at zone A in FIG. 14 and the speed of pressure rollers was synchronized with the line speed when a bag was made in the method of the invention.

For each example mentioned above, tests were made for the items such as the state of air bubbles generated in the sealed portion and creases on the sealed portion.

Air bubble in sealed portion: Air bubbles in the area whose width is not less than a half of a sealed portion are to be checked visually.

Creases on sealed portion: Existence of creases on the area whose width is not less than a half of a sealed portion is to be checked visually.

Criteria for evaluation are as follows.

Air bubble in sealed portion:

| | A | B | C | D |
|---|---|---|---|---|
| Fraction defective: | less than 1% | less than 5% | less than 20% | 20% or more |

Creases on sealed portion:

| | A | B | C | D |
|---|---|---|---|---|
| Fraction defective: | less than 1% | less than 5% | less than 20% | 20% or more |

Results are shown in Table 2.

TABLE 2

| Heat sealing method | | Example 1 | Example 2 | Example 3 | Example 4 | Example 5 | Example 6 | Example 7 | Example 8 | Comparative example 1 | Comparative example 2 | Comparative example 3 | Comparative example 4 |
|---|---|---|---|---|---|---|---|---|---|---|---|---|---|
| Air bubble in sealed portion | Invention | B | A | A | B | A | B | A | A | A | A | B | D |
| | Conventional | C | C | C | C | C | C | C | C | A | A | C | D |
| Crease on sealed portion | Invention | B | B | A | B | B | B | A | A | A | A | B | D |
| | Conventional | C | C | C | C | C | C | C | C | A | A | C | D |

From the results of Table 2, it is apparent that the bag-making method of the invention offers a bag equal to or better than that made through a conventional method, and it is understood that the method of the invention is suitable for the materials for packing of the invention.

Incidentally, Comparative Example 4 was evaluated to be usable in terms of tear strength, moisture proofing, flammability and aptitude for recycling which are evaluation criteria for packing materials before bag making. However, as shown in table 2, this sheet is quite unsuitable for bag-making by a process including heat-sealing step such as the method of the invention.

What is claimed is:

1. A method for producing a bag comprising the steps of:

running a sheet for producing a bag in a running direction, said sheet comprising a first layer for forming an innermost surface of the bag and second layer for forming an outermost surface of the bag;

facing edges of said first layer of said sheet toward one another to form the innermost surface and the outermost surface of said bag, the edges of the first layer extending parallel to the running direction;

heating a portion of said sheet in a heating means having a pair of heater bars extending parallel to the running direction by continuously running the sheet between said heater bars, while maintaining a uniform first distance between the edges of said first layer and maintaining a second distance between one of said heater bars and a portion of said second layer facing said one of said heater bars, the second distance being greater than said first distance in said heating means; and compressing said sheet to seal a portion of said first layer, wherein said sheet comprises not less than 70% by weight of polyethylene and 1% to 10% by weight of a light shielding material based on the weight of said sheet, said second layer comprises polyethylene, and a Vicat softening point of said second layer of said sheet is higher by not less than 20° C. than a Vicar softening point of said first layer of said sheet.

2. The method of claim 1, wherein the Vicar softening point of said second layer is higher by 25° C. to 50° C. than a Vicar softening point of said first layer.

3. The method of claim 1, wherein said light shielding material is carbon black.

4. The method of claim 1, wherein said sheet comprises not less than 85% by weight of polyethylene based on the weight of said sheet.

5. The method of claim 1, wherein said sheet further comprises a reflective material.

6. The method of claim 1, wherein said material further comprises polypropylene or nylon.

7. The method of claim 1, wherein the second distance is not less than 0.5 mm.

8. The method of claim 1, wherein said second layer is chilled between said heating step and said compressing step.

9. The method of claim 1, wherein a running speed of said portion in said heating means is the same as a running speed of the remaining portion of said sheet.

10. The method of claim 1, wherein said second layer of said sheet comprises 90% to 100% by weight of polyethylene based on the weight of said second layer.

* * * * *

UNITED STATES PATENT AND TRADEMARK OFFICE

CERTIFICATE OF CORRECTION

PATENT NO. : 5,540,644

DATED : July 30, 1996

INVENTOR(S) : Naohito NARAOKA et al

It is certified that error appears in the above-indentified patent and that said Letters Patent is hereby corrected as shown below:

On Title page,
In the Title, Line 1, "LIGHT SENSITIVE" should read --LIGHT-SENSITIVE--;

Claim 1, Column 14, Line 63, "Vicar" should read --Vicat--;

Claim 2, Column 14, Line 65, "Vicar" should read --Vicat--;

Claim 2, Column 14, Line 67, "Vicar" should read --Vicat--;

UNITED STATES PATENT AND TRADEMARK OFFICE

CERTIFICATE OF CORRECTION

PATENT NO. : 5,540,644

DATED : July 30, 1996

INVENTOR(S) : Naohito NARAOKA et al

It is certified that error appears in the above-indentified patent and that said Letters Patent is hereby corrected as shown below:

Claim 6, Column 15, Line 8, "material" should read --sheet--.

Signed and Sealed this

Twelfth Day of November, 1996

*Attest:*

Bruce Lehman

BRUCE LEHMAN

*Attesting Officer*

*Commissioner of Patents and Trademarks*